United States Patent [19]

Russell

[11] 4,051,802

[45] Oct. 4, 1977

[54] OPERATING HANDLE FOR PIVOTALLY MOUNTED TROLLING MOTOR

[75] Inventor: Owen Clarkson Russell, Butte Des Morts, Wis.

[73] Assignee: Brunswick Corporation, Skokie, Ill.

[21] Appl. No.: 610,308

[22] Filed: Sept. 4, 1975

[51] Int. Cl.[2] ..... B63H 5/13

[52] U.S. Cl. ..... 115/17; 115/18 E

[58] Field of Search ..... 115/18 R, 17, 18 E, 115/18 A; 114/144 A, 162; 248/4; 74/543, 544, 523

[56] References Cited

U.S. PATENT DOCUMENTS

| | | | |
|---|---|---|---|
| 1,553,183 | 9/1925 | Mould | 115/18 R |
| 1,804,442 | 5/1931 | Smith | 115/18 R |
| 2,682,248 | 6/1954 | Sitz | 115/18 R |
| 2,903,903 | 9/1959 | Jaromy | 115/18 R |
| 3,174,357 | 3/1965 | Conklin | 115/18 R |
| 3,602,181 | 8/1971 | Harris | 115/18 E |
| Re. 25,048 | 10/1961 | Hulsebus | 115/17 |

*Primary Examiner*—Trygve M. Blix
*Assistant Examiner*—Jesus D. Sotelo
*Attorney, Agent, or Firm*—Andrus, Sceales, Starke & Sawall

[57] ABSTRACT

An elongated tubular handle is secured to the upper head of an electric trolling motor. A steering push-pull cable and electrical cables for guided and protected movement during the raising of the motor. The handle is formed with rectangular cross-section and of a relatively stiff, rubber and tapers from a heavy, stable end connected to the head to a relatively thin section outer grip end. The handle extends inwardly into the boat for convenient pulling directly backwardly on the outer end of the handle to cause the motor to pivot upwardly and inwardly into the boat without kinking of the cables and without twisting of the handle in the operator's hand.

9 Claims, 6 Drawing Figures

SPEED
ROTATION

OPERATING HANDLE FOR PIVOTALLY MOUNTED TROLLING MOTOR

BACKGROUND OF THE INVENTION

This invention relates to a pivotally mounted trolling motor and particularly to an operating handle for selectively pivoting of the motor between drive position and into a raised transport position.

In the art of trolling, small electric driven outboard motor units are mounted to the transom of a boat and employed for slow speed maneuverability and positioning of the fishing boats. The electric drive motor is housed within the lower unit and coupled to drive a suitable propeller. A unique electric trolling motor is employed in bass fishing and the like where the motor is primarily employed for limited maneuverability within a fishing area to properly locate the boat with respect to and positioning of the fishermans lines. The motor preferably provides a high thrust, low speed output which is adapted to accurate and fine control of the turning and moving forces. The motor is turned by a foot control coupled by push pull cables to a turning gear means in the head of the motor. Generally, the trolling motor is separate from a high powered internal combustion outboard motor which is provided for rapid propulsion to the fishing location or spot. The trolling motor includes a pivotal support bracket assembly which is normally mounted to a forward boat deck and permits dropping of the lower unit of motor into the water or alternatively raising of the motor completely from the water and lying on the deck during the high speed transportation of the fishing craft. Generally, the support bracket assembly includes a horizontal mounting bracket which is fixedly mounted to the boat and pivoting bracket to which the electric trolling motor is secured. Various linkage systems have been suggested for supporting and orienting of the outboard motor unit with respect to the mounting bracket to permit the convenient raising and lowering of the outboard motor unit. Generally, such linkages are relatively complex and are exposed moving elements creating a potentially hazardous environment particularly where the operator's attention may be on other matters and time is important. A particularly unique and satisfactory enclosed construction is illustrated in U.S. Pat. No. 4,008,680 of Charles F. Alexander, Jr. entitled "PIVOTAL MOUNT ASSEMBLY FOR TROLLING MOTORS" assigned to the same assignee to the same assignee. The trolling motor as disclosed in such application and other prior art is particularly employed in competitive bass fishing and the like where it is important that the fisherman can conveniently and rapidly raise and lower the trolling motor. As disclosed in that application the pivotal mounting includes a gear drive system such that the motor rotates in a swivel when raised and lowered. This lays the motor with head and lower unit on its side during transport and locates the lower unit centered with respect to the boat in the lowered propulsion position.

Generally, in the prior art to the trolling motor, the trolling motor is constructed to be raised and lowered only by moving to the area of the motor for manual grasping of the control head of the trolling motor. This is time consuming and presents another possible action which may prevent efficient and professional execution by the fisherman either by error or lack of skill. In fact, the fisherman will often grasp the steering cable which extends from the motor head and pull on the motor to raise and pivot it into the boat. As it pivots down to the deck the cable will often be kinked or bent, particularly at the entrance to the head. This may damage the cable and eventually result in breaking of the cable. Further, the motor mount is often angularly oriented on the deck with the cable extending backwardly along the center of the boat. When the operator pulls straight back, the motor pivots along its mounting plane and may cause further twisting and kinking of the cable unit. Such trolling motors are reasonably heavy and a strong pull on the motor is normally needed to at least initiate the upward movement. Further, the twisting force on the hand of the fisherman may therefore result in slipping or the like with an undesirably slow or troublesome movement of the motor.

Notwithstanding the several difficulties associated with the prior art devices, the prior art has not provided any convenient and reliable alternatives.

SUMMARY OF THE PRESENT INVENTION

The present invention is particularly directed to an elongated operating handle secured to the upper portion of an electric trolling motor and permitting the convenient and direct raising of the trolling motor from the propelling position from location in spaced relation to the motor unit.

Generally, in accordance with the present invention an elongated handle member is secured to the upper end of the motor unit and is formed of a flexible material providing proper transfer of force to the head for the pivoting and rotation of the motor unit without twisting of the manually grasped end of the operating handle unit. In accordance with a particularly unique and novel feature and embodiment of the present invention, the operating handle is formed of an integral elongated rubber-like material which is readily deformable and bendable to permit twisting and bending relative to the grip. The elongated handle has the one end firmly affixed to the head unit and extends outwardly therefrom.

In a practical and novel embodiment, the elongated rubber-like handle is formed as a tubular member of a relatively soft rubber-like material with a generally rectangular cross-section. The head end of the handle is fixedly attached to the head as by clamping between separable parts of the head. The handle extends outwardly in alignment with the head and with the principal axis of the rectangular cross-section in the principal plane of the head. The handle is further configured to taper inwardly from a relatively heavy head end, particularly along the sides to an outer, relatively small handle portion. The wall thickness also preferably is tapered from a thicker wall at the head to a relatively thin wall portion in the handle. The outermost end of the handle is preferably provided with a slight enlargement and the grip is grooved for firm grasping of the handle.

The operating cables extend through the handle and are guided and protected during the raising of the motor. The handle is thus preferably formed as an elongated tubular member with a gradual or progressive change in stiffness from the firm securement to the head outwardly to the grip. This prevents the sharp bending or kinking of the cables when pulling the motor into the boat.

Although the handle is formed of a relatively stiff, suitable rubber-like material and tapers from a relatively heavy and stable connected section to a relatively thin section, the handle is readily constructed as a self-supporting element which will project outwardly from the head with the unit in the propulsion position. The handle extends inwardly into the boat and over the mounting deck for convenient manipulation and grasping by the fisherman even though he is not immediately adjacent to the motor. Further, the flexibility of the handle is such that the operator may pull directly backwardly on the outer end of the handle and the motor unit will pivot upwardly and inwardly into the boat without kinking of the cables and without twisting of the handle in the operator's hand. This provides for a very reliable or convenient and reliable retraction of the trolling motor from the fore end of the boat.

Thus, the present invention provides for a very simple solution to a significant problem in the art of trolling motors particularly for bass fishing and the like.

BRIEF DESCRIPTION OF THE DRAWING

The drawing furnished herewith illustrates a preferred construction of the present invention in which the above advantages and features are clearly disclosed as well as others that will readily be understood from the following description.

In the drawing.

DESCRIPTION OF THE ILLUSTRATED EMBODIMENTS

Figures 1, 2, 4, 5, 6:
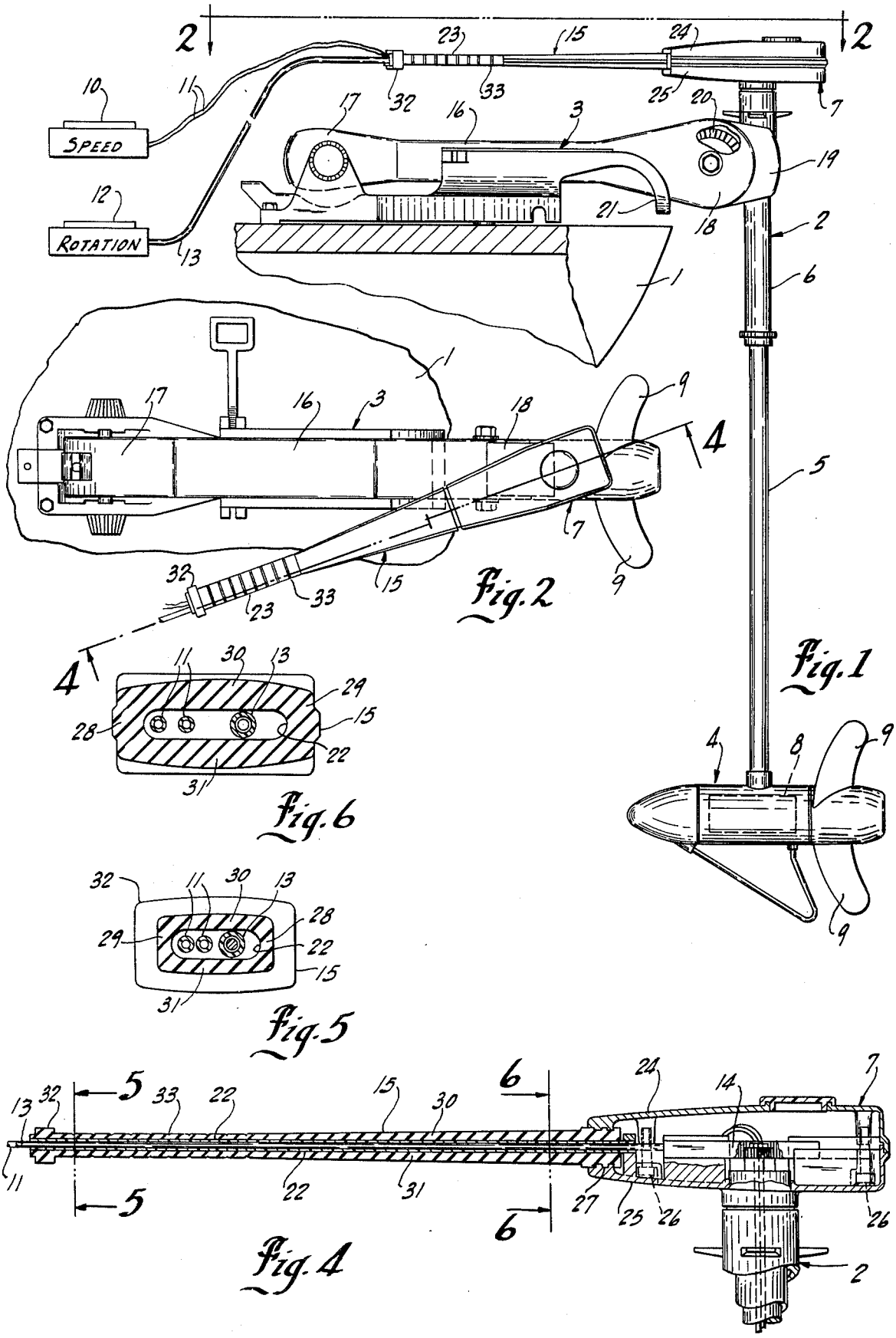
FIG. 1 is a side elevational view of a trolling motor in the propulsion position with respect to a boat, of which only the fragmentary portion of the motor mounting foredeck is shown.
FIG. 2 is a top elevational view of FIG. 1.
FIG. 4 is a longitudinal vertical section through the handle.
FIG. 5 is a transverse vertical section through the handle taken generally on line 5—5 of FIG. 4 and illustrating the grip end of the handle.
FIG. 6 is a view similar to FIG. 5 taken generally on line 6—6 of FIG. 4 and illustrating the attachment end of the handle.
Figure 3:
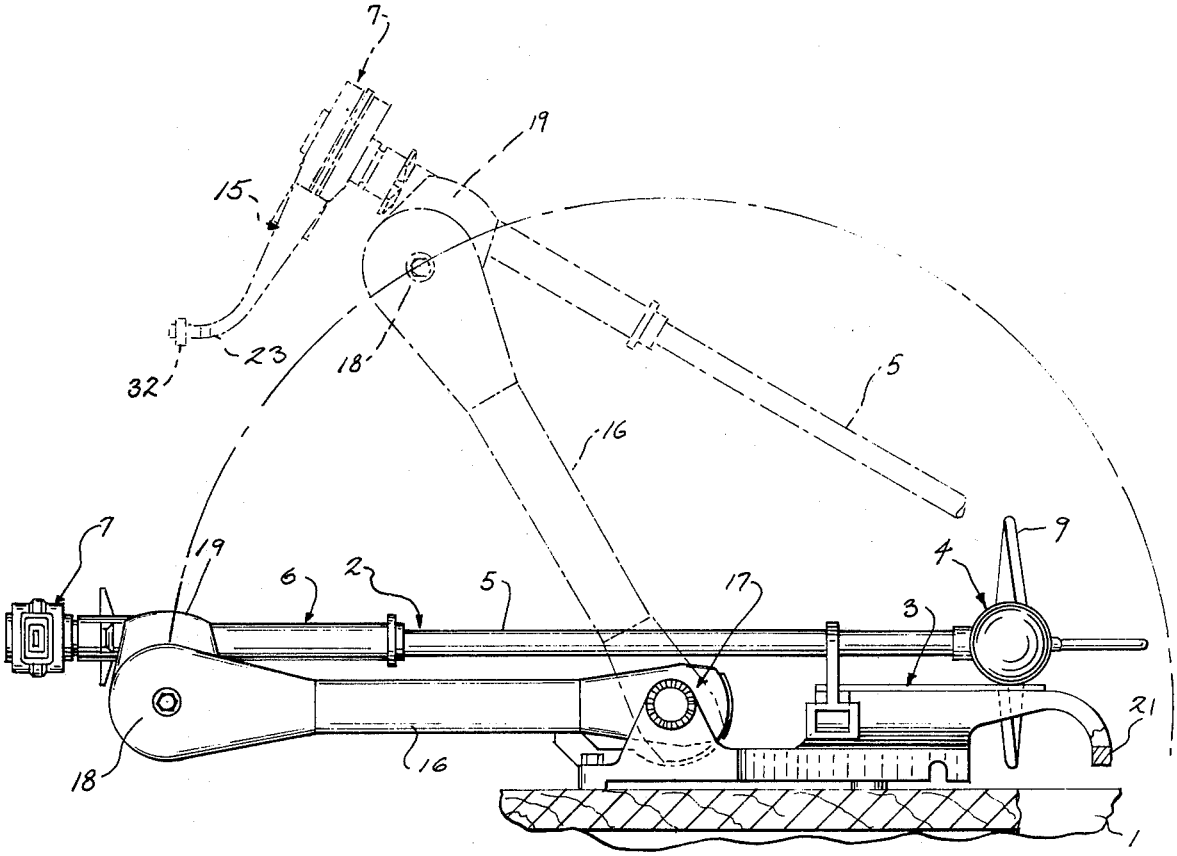
FIG. 3 is a fragmentary side elevational view illustrating the trolling motor in the raised position, and a partially raised position in phantom.

Referring to the drawings and particularly to FIG. 1, a fragmentary portion of the foredeck of a boat 1 is illustrated with a trolling motor 2 secured thereto by a suitable pivotal mounting assembly 3 for positioning between the depending propulsion position of FIG. 1 and the transport position of FIG. 3. The illustrated trolling motor 2 is an electric driven motor having a lower unit 4 secured to a supporting tubular tube 5 within a swivel tube 6 by a clamp. Tube 6 terminates at the upper end in a generally flat, rectangular head 7. A motor 8, preferably of the permanent magnet type, is secured within the lower propeller unit 4 and coupled to drive a propeller 9. The speed of the motor 8 and, therefore, the propeller 9 is controlled from within the boat 1 and preferably includes a foot speed control unit 10 of any suitable construction. Generally the speed control unit 10 is connected in the circuit of the motor 8 through connecting leads 11 which extend through the head 7 and downwardly the pipe 5 and into the circuit of motor 8. The control circuit, not shown, for the motor may be housed within the lower unit. The turning of the motor 8 and, therefore, the boat is also controlled from within the boat and preferably through a conventional foot unit 12 which is connected through a push-pull cable unit 13 to a rack and pinion mechanism 14 within the head 7 which selectively turns the upper end of the supporting shaft 5. Generally, the lower unit and associate supports, as well as the connection of the speed and steering controls, may be similar to any of the well-known systems and no further description thereof is given.

The present invention is particularly directed to a unique handle unit 15 secured to the forward end of the housing 7 and providing for the convenient raising of the trolling motor 2 from the propulsion position wherein it overhangs the outer edge of the deck as shown in FIG. 1 to a transport position wherein it lies onto the deck 1 as shown in FIG. 3. In the illustrated embodiment of the invention, the pivot mounting assembly 3 is constructed in accordance with the teaching of the previously noted U.S. Pat. No. 4,008,680, entitled "PIVOTAL MOUNT ASSEMBLY FOR TROLLING MOTORS" and is, therefore, only briefly described herein. Generally, the assembly 3 includes a pivot arm 16 pivotally supported to a mounting bracket 17 as at 18. The swivel tube 6 is secured to a gear member 19 which is pivotally supported within the motor end of arm 16 and coupled to gear train 20 formed therein to positively position the motor between the two illustrated positions. The bracket 17 includes an outer curved guide end 21 which turns the motor about the swivel tube 6 as it is raised. Thus, as the motor 2 is raised by pivoting of the arm 16 the gear train pivots the trolling motor within the outer end of the arm 18. Simultaneously, the motor 1 is preferably rotated to lie on its side upon the upper wall of guide 21 in the transport position, as shown in FIG. 3. This construction thus provides for optimum positioning of the motor for propulsion and simultaneously when moving to the transport position also repositions the motor in close spaced relation to the boat deck for convenient and reliable transportation.

The handle unit 15 which particularly forms the subject matter of the present invention is an elongated member which in the propulsion position extends aft from the head 7 inwardly of the boat 1 to locate a grip end 22 within the boat and particularly overlying the deck 1 for convenient grasping by the fisherman. The handle is formed as a tubular hollow member with an internal passageway 22 of a convenient size for accepting the power cables 11 and the push-pull positioning cable 13 which extend through the handle 15 and into the head 7. The head end of the handle 15 is affixed to the forward end of the head 7. In the illustrated embodiment, head 7 is shown as a separable housing member having an upper member 24 and a lower member 25 interconnected by suitable clamping bolts 26. The head end of the handle 15 and the housing members have complementing notched portions 27 which provide firm, reliable clamping and attachment of the handle 15 to the head 7 to transmit pulling force on the outer grip end of handle 15 to the head 7 and, therefore, to the trolling motor 2.

The handle 15 in accordance with the preferred illustrated embodiment is formed of a relatively stiff, rubber-like material.

The handle 15 has a generally rectangular cross-section with a relatively heavy and stable end clamped within the head 7. The sidewalls 28 and 29 of the handle 15 taper inwardly to the grip end 23 as shown in FIG. 2. Similarly, the upper and bottom walls 30 and 31 of the handle 15 taper toward each other to the grip end 23 which is formed with a generally constant rectangular cross-section throughout its length.

Further, as illustrated in FIGS. 4 through 6, the thickness of the handle walls taper downwardly from the notched end portion 27 to the grip end 23. The tapered construction and the use of the self-supporting, soft, rubber-like material results in an increasingly flexible handle from the head 7 to the grip end 21, with, however, a firm and stable attachment portion at the head 7 to firmly support the electrical speed and direction control cable means. As a result, the handle 15, however, has sufficient stiffness to assume the position of FIG. 1; that is, with the handle extending inwardly into the boat over the deck 1 and mounting assembly 3 for convenient manipulation by the fisherman. However, when the fisherman grasps the handle at the grip end and pulls inwardly on the handle 15, the motor pivots within assembly 3, as illustrated in FIGS. 2 and 3. The fisherman pulls straight back with the motor pivoting up into the boat and down toward the horizontal position. This will cause the handle 15 to bend relative to the head connection. However, the gradual change in stiffness of the handle 15 and the fact that it is somewhat more flexible in the vertical direction will cause a generally smooth, gradual change. This will, of course, prevent formation of sharp bends and kinks and thus prevent damage to the cables within the handle. As shown in FIGS. 1 and 2, the arm 16 may be mounted at an angle with respect to the boat center. The head 7 and handle 15 will normally extend rearwardly into the boat on or near the center. The arm 16 will thus pivot sideways further tending to twist and bend the handle.

The motor may also be rotated by the foot control within the swivel tube 6 which introduces further turning and twisting forces on the handle. The portion of the handle 15 immediately adjacent the outer grip 23 is sufficiently flexible that the handle will deform, bend and deflect in the manner of generally universal swivel joints with a smooth gradual change to permit the fisherman to conveniently pull inwardly on the handle while accommodating the pivoting motion of the trolling motor.

The outer end of the handle 15 is preferably formed with an outer enlargement 32 at the end of the grip end 23. The grip end 23 may also be provided with a plurality of parallel notches or encircling recesses 33 which in combination with the outer enlargements 32 provide for firm reliable gripping of the handle 15 even when wet.

The fisherman can, therefore, conveniently and reliably retract the trolling motor in a very rapid manner within the boat by merely unlocking the motor assembly and then grasping the handle and pulling inwardly of the boat. Further, when the handle is released, the resilient construction will return the handle to the extended position of the head 7. The present invention thus provides a simple and inexpensive handle for positioning of the trolling motor 2.

Various modes of carrying out the invention are contemplated as being within the scope of the following claims, particularly pointing out and distinctly claiming the subject matter which is regarded as the invention.

I claim:

1. In a trolling motor apparatus including an outboard motor unit pivotally affixed to a horizontally located swivel bracket, the improvement in an operating handle comprising an elongated handle member, means securing one end of said member to the upper end portion of said outboard motor with the outer end defining a grip end, said rubber-like material being readily deformable to permit twisting and bending relative to said grip end and having sufficient stiffness to be self-supporting, and control cables extend through said handle.

2. In the trolling apparatus of claim 1 wherein said handle member is a longitudinally tapered member having a heavy stable portion at the motor end and progressively thinner outer portion of increasing flexibility to the grip end.

3. In a trolling motor apparatus having a mounting bracket for mounting upon the deck of a watercraft and an outboard motor unit pivotally connected to said bracket for positioning between a vertical drive position and a horizontal transport position, said outboard motor unit having a lower unit rotatably mounted within a swivel means and having an upper head affixed to said swivel means, said outboard motor unit being rotatable to lie upon its side in the transport position, an elongated tubular handle secured to the upper head of said outboard motor unit and extended forwardly from the front of the motor unit to an outer grip end, control cable means extending through said handle and connected at the inner end of the motor, said handle supporting said cables and being formed of a flexible material to form bending means permitting the movement of the outer grip end of the handle with the motor pivoting to the horizontal position without exerting significant sharp bends in the handle and minimizing twisting forces on the outer grip end.

4. In the apparatus of claim 3 wherein said handle is a tubular member formed of an integral flexible rubber-like medium with a longitudinal opening, member being self-supporting to extend outwardly of said upper head and being bendable to minimize turning forces on the gripping end, and motor control cable means extending through the longitudinal opening of said tubular member.

5. In the trolling motor apparatus of claim 4 wherein said tubular member is a longitudinally tapered member and having a heavy stable portion at the motor end and progressively thinner outer portion of increasing flexibility to said grip end.

6. In the apparatus of claim 4 wherein said member has a generally rectangular cross-section with major top and bottom walls and minor sidewalls, said member being formed with generally constant thickness top and bottom walls and with progressively inwardly tapered sidewalls of a progressively thinner wall thickness to a generally square outermost grip end.

7. The trolling motor apparatus of claim 4 wherein said motor unit has an upper head including a two-piece housing, said handle member being clamped between said two-piece housing and including interlocking projections to firmly affix the handle to the head.

8. The trolling motor apparatus of claim 4 wherein said tubular member has a generally rectangular cross-section with major top and bottom walls and minor sidewalls, said member being formed with a generally constant thickness top and bottom walls and with progressively thinner sidewalls to a generally square outermost grip end, said motor unit having an upper steering head including a two-piece housing, said handle member being clamped between said two-piece housing and including interlocking projections.

9. A trolling motor apparatus having a mounting bracket and an outboard motor unit pivotally connected to said bracket for positioning between a vertical drive position depending from the bracket and a horizontal transport position overlying the bracket with the outermost end of the motor unit within the end of the bracket, said outboard motor including an elongated head, comprising an elongated tubular handle secured to the head of said outboard motor unit and extended forwardly from the front of the motor unit to an outer grip end, said handle formed of flexible material permitting the horizontal movement of the outer grip end of the handle with the motor unit pivoting to the horizontal position and transport position, speed control cable means extended through said handle to vary the engine speed, and turning control cable means extending through said handle and terminating within said head.

* * * * *

UNITED STATES PATENT AND TRADEMARK OFFICE

CERTIFICATE OF CORRECTION

PATENT NO. : 4,051,802

DATED : October 4, 1977

INVENTOR(S) : OWEN CLARKSON RUSSELL

It is certified that error appears in the above-identified patent and that said Letters Patent are hereby corrected as shown below:

| | | | | |
|---|---|---|---|---|
| Column | 1, | Line | 49, | cancel "to the same assignee" after "assignee" (first occurrence); |
| Column | 2, | Line | 38, | after "grip" insert --- end ---; |
| Column CLAIM 1 | 5, | Line | 67, | after "grip end" insert --- said handle member being formed of an integral, flexible, rubber-like material ---; |
| Column CLAIM 1 | 6, | Line | 2, | after "cable" cancel "extend" and insert --- extended ---; |
| Column CLAIM 3 | 6, | Line | 21, | after "end" cancel "of" and insert --- to ---; |
| Column CLAIM 4 | 6, | Line | 30, | after "opening" insert --- said ---; |

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*